US010385573B2

(12) United States Patent
Van Leuven

(10) Patent No.: US 10,385,573 B2
(45) Date of Patent: Aug. 20, 2019

(54) SNOW BRAKE ANCHORING SYSTEM

(71) Applicant: Jeffrey Van Leuven, Spokane, WA (US)

(72) Inventor: Jeffrey Van Leuven, Spokane, WA (US)

(73) Assignee: Jeffrey Van Leuven, Spokane, WA (US)

( * ) Notice: Subject to any disclaimer, the term of this patent is extended or adjusted under 35 U.S.C. 154(b) by 0 days.

(21) Appl. No.: 15/877,578

(22) Filed: Jan. 23, 2018

(65) Prior Publication Data

US 2019/0226214 A1 Jul. 25, 2019

(51) Int. Cl.

| | |
|---|---|
| ***E04D 13/00*** | (2006.01) |
| ***E04D 13/10*** | (2006.01) |
| ***E01H 5/10*** | (2006.01) |
| ***E04D 1/30*** | (2006.01) |
| ***E04D 3/40*** | (2006.01) |

(52) U.S. Cl.

CPC ..... *E04D 13/10* (2013.01); *E01H 5/102* (2013.01); *E04D 1/30* (2013.01); *E04D 3/40* (2013.01)

(58) Field of Classification Search

CPC .. E04D 13/10; E04D 3/40; E04D 1/30; E01H 5/102

USPC ..... 52/24

See application file for complete search history.

(56) References Cited

U.S. PATENT DOCUMENTS

| | | | | |
|---|---|---|---|---|
| 5,715,640 | A | 2/1998 | Haddock | |
| 6,256,934 | B1 * | 7/2001 | Alley | E04D 13/10 52/24 |
| 6,453,623 | B1 * | 9/2002 | Nelson | E04D 13/10 411/432 |
| 7,513,080 | B1 | 4/2009 | Showalter | |
| 7,703,256 | B2 * | 4/2010 | Haddock | F16B 5/0004 52/24 |
| 8,528,888 | B2 * | 9/2013 | Header | E04D 13/10 269/91 |
| 9,085,900 | B2 * | 7/2015 | Haddock | E04C 2/38 |
| 9,431,953 | B2 | 8/2016 | Stearns et al. | |
| 9,447,988 | B2 | 9/2016 | Stearns et al. | |
| 2005/0257434 | A1 * | 11/2005 | Hockman | E04D 13/10 52/24 |
| 2005/0284995 | A1 * | 12/2005 | Hutter, III | B64C 1/406 248/235 |
| 2010/0083588 | A1 * | 4/2010 | Hockman | E04D 13/10 52/24 |
| 2011/0214367 | A1 * | 9/2011 | Haddock | F24S 25/615 52/173.3 |

* cited by examiner

*Primary Examiner* — Basil S Katcheves

(74) *Attorney, Agent, or Firm* — Randall Danskin P.S.

(57) ABSTRACT

A snow brake anchoring system to prevent accumulations of snow from sliding off an inclined roof, by securing a snow brake anchor to the inclined roof, the snow brake anchor having a body with a first and second end, a top surface, a first and second leg, a bottom of the first leg, an outwardly facing surface of the first leg, an inwardly facing surface of the first leg, a bottom of the second leg, and an inwardly facing surface of the second leg, the body defining a channel extending between the first end and the second end and between the inwardly facing surface of the first leg and the inwardly facing surface of the second leg, the body further having a laterally extending lip portion that extends perpendicularly away from the outwardly facing surface of the first leg of the body and is co-planar with the top surface.

9 Claims, 5 Drawing Sheets

SNOW BRAKE ANCHORING SYSTEM

FIELD OF INVENTION

The present invention relates generally to a snow brake anchoring system, and more particularly to a snow brake anchor that attaches to a standing seam of an inclined roof for use in preventing accumulations of snow from sliding off of the inclined roof.

BACKGROUND

Snow brakes are used to prevent accumulations of snow from sliding off inclined roofs. With the use of a snow brake, accumulated snow is allowed to melt, or sublime directly to vapor, while being retained in place on the inclined roof.

Accumulations of snow that slide off roofs can cause injury to people or damage to property therebelow due to the weight of the snow, the speed at which the snow falls, and the unpredictability of when and how much snow will slide off the roof. Snow brake systems are of particular use with planar roofs, where minimal frictional resistance and planar surfaces contribute to the sliding of the snow.

Planar metal roofs are commonly used in industrial applications, such as factories or shops. Due to the type of work commonly associated with factories or shops, people, vehicles, and other equipment is often moving in and out of such buildings. Further, these types of buildings commonly also have irregular heating patterns. For example, a factory may have a heated office, an unheated loading area, and industrial machinery that puts off large amounts of heat. All of these different areas may be contained under a single roof. These irregular heating patterns can lead to irregular melting patterns of snow on the roof. Irregular melting patterns can lead to unpredictable time and places that snow slides off of the roof. Even further, there may be many people unfamiliar with the configuration and possible dangers of the building, such as independent trucking operators. The combination of the unpredictable melting patterns and the people unfamiliar with the melting patterns leads to risks of possible injury to people and equipment.

Similarly, many homes, residences, cabins, ski condos, recreational properties, and resorts in snowy locales also have planar metal roofs, and are subject to similar issues. For example, many homes have wood burning stoves or similar heating apparatus, which lead to irregular heating patterns. Further, many of these types of buildings have attached covered areas that are not walled in, to park equipment or store wood for example. These covered areas may be attached to the same roof system as the home. Again, this leads to an irregular heating pattern between the home and the covered area. In addition, the nature of these types of buildings, in that they may not be occupied regularly, leads to similar risks. Further, children, animals, or even adults who are not aware of the possibility of sliding snow may be in danger of injury. Again, the combination of the unpredictable melting patterns and the people unfamiliar with the melting patterns leads to risks of possible injury to people and equipment.

In locations that receive significant amounts of snow, there is also significant amounts of freezing. Therefore, ice dams or other accumulations of snow and ice may block gutters in these locations and lead to ice ridges on and along portions of the roof. Buildings with planar metal roofs, such as factories, shops, cabins, condos, and ski lodges also typically have very high roofs. Therefore, accessing these gutters to service the gutters and/or to remove ice dams is difficult and potentially dangerous, and the sliding of accumulations of snow may damage the gutters and even tear the gutters from the roof eaves causing substantial damage.

Metal roofs are generally formed of plural large planar or minimally contoured metal panels and often have spaced apart parallel standing seams at adjacent edges of the separate panels. Standing seams are created using the opposing edges of adjacent planar roof panels. A first edge portion of each planar roof panel is bent generally vertically upwardly to form an upwardly extending lip (additional configurations are also available). The opposing second edge of the same planar roof panel is similarly bent upwardly, to form a second lip, and this second lip at the second edge is thereafter folded over or bent downwardly into a narrow inverted "U" shaped channel. The inverted narrow "U" shaped channel fits over and encloses/engages with the first upstanding lip of an adjacent planar roof panel. In this way, each planar roof panel has one half of a cooperating roof seam at each opposing edge portion.

As will be understood from the description herein, the first and second edge portions of adjacent planar roof panels overlap so that the inverted narrow "U" shaped channel of the second edge portion overlaps the first edge portion of an immediately adjacent roof panel. Engagement of the first upwardly extending lip into the second narrow inverted "U" channel provides an edge interconnection of the adjacent planar roof panels, and this interconnection may be sealed by known means so as to be water-tight. Further, the cooperating and interconnecting edge portions may be formed during the manufacturing of the roof panels, which eases the installation and interconnection of the planar roof panels. Due to this construction, replacing roof sections when they are damaged or have reached the end of their useful life is simplified. However, like any roof, maintaining the integrity of the roof is critical. Leaks created by any holes in a roof can cause a myriad of problems, from mold to ruined equipment. This is a particular concern with metal roofs, since there are typically not several layers of roofing or large overlapping portions of roofing, as there are with asphalt shingle roofs.

The standing seams, besides making installation and maintenance more convenient, also present an opportunity to install additional apparatus on the roof.

BRIEF SUMMARY OF THE INVENTION

A first aspect of the present invention is a snow brake anchoring system for a planar inclined roof to prevent accumulations of snow from sliding off the inclined roof, the roof having a generally planar inclined surface between an upper roof crest portion and a lower roof eave portion with a plurality of spaced apart generally parallel standing seams that extend generally perpendicularly upwardly from the inclined roof surface and extending between the roof crest portion and the roof eave portion, the snow brake anchoring system comprising a snow brake anchor having an body with a first end, a second end, a top surface, a first leg, a second leg, a bottom of the first leg, an outwardly facing surface of the first leg, an inwardly facing surface of the first leg, a bottom of the second leg, an outwardly facing surface of the second leg, and an inwardly facing surface of the second leg, the body defining a channel extending between the first end and the second end and between the inwardly facing surface of the first leg and the inwardly facing surface of the second leg, the channel having a depth dimension between a channel opening between the bottom of the first leg and the bottom of the second leg and a channel base defined by a transverse face proximate to the top surface of the body, the body further having a laterally extending lip portion that extends perpendicularly away from the outwardly facing surface of the first leg of the body and co-planar with the top surface of the body, the lip portion having a first end, a second end, a top surface, a bottom surface, and a laterally outer edge, the lip portion extending between the first end of the body and the second end of the body, and having a thickness between the top surface of the lip portion and the bottom surface of the lip portion; and further having fasteners for releasably securing the snow brake anchor to the standing seam of the roof that is within the channel without penetrating the standing seam; and fasteners for releasably securing a snow brake to the snow brake anchor.

A further aspect of the present invention is a snow brake anchoring system wherein a plurality of spacedly arrayed threaded through holes defined in the first leg of the body comprise three spacedly arrayed threaded through holes that are located approximately equidistant from the channel base and the bottom of the first leg of the body, a first of the three spacedly arrayed threaded through holes located proximate the first end, a second of the three spacedly arrayed threaded through holes located proximate the second end, and a third of the three spacedly arrayed threaded through holes located approximately equidistant from the first end and the second end of the body.

A further aspect of the present invention is a snow brake anchoring system wherein the first of the three spacedly arrayed threaded through holes defined in the first leg and the second of the three spacedly arrayed threaded through holes defined in the first leg are located approximately equidistant from the third of the spacedly arrayed threaded through holes defined in the first leg.

A further aspect of the present invention is a snow brake anchoring system wherein the plurality of spacedly arrayed holes defined in the lip portion are located approximately equidistant from the laterally outer edge and the outwardly facing surface of the first leg, a first of the plurality of spacedly arrayed threaded through holes defined in the lip portion proximate the first end, and a second of the plurality of spacedly arrayed threaded through holes defined in the lip portion proximate the second end.

A further aspect of the present invention is a snow brake anchoring system wherein the body and the channel together, excluding the lip portion, have a substantially rectangular cross-sectional shape.

A further aspect of the present invention is a snow brake anchoring system wherein the body and the channel together, excluding the lip portion, have a substantially square cross-sectional shape.

A further aspect of the present invention is a snow brake anchoring system wherein the snow brake anchor is composed of a metallic alloy.

A further aspect of the present invention is a snow brake anchoring system wherein the metallic alloy comprises heat-treated aluminum.

A further aspect of the present invention is a snow brake anchoring system wherein the snow brake anchor is composed of a durable, temperature resistant polymer.

A further aspect of the present invention is a snow brake anchoring system wherein the channel is rectangular.

A further aspect of the present invention is a snow brake anchoring system wherein the channel base is other than rectangular.

A further aspect of the present invention is a snow brake anchoring system wherein the first leg and the second leg are substantially rectangular cuboids.

A further aspect of the present invention is a snow brake anchoring system for an inclined roof to prevent accumulations of snow from sliding off the inclined roof, the roof having a generally planar inclined surface between an upper roof crest and a lower roof eave with a plurality of spacedly apart generally parallel standing seams that extend generally perpendicularly upwardly from the inclined roof surface and extending substantially between the roof crest and the roof eave, the snow brake anchoring system comprising a snow brake anchor having a body with a first end, a second end, a top surface, a first leg, a second leg, a bottom of the first leg, an outwardly facing surface of the first leg, an inwardly facing surface of the first leg, a bottom of the second leg, an outwardly facing surface of the second leg, and an inwardly facing surface of the second leg, the body further defining a channel extending between the first end and the second end and between the inwardly facing surface of the first leg and the inwardly facing surface of the second leg, the channel having a depth dimension between a channel opening between the bottom of the first leg and the bottom of the second leg and a channel base defined by a transverse face proximate to the top surface of the body, the body further having a laterally extending lip portion that extends perpendicularly laterally outwardly from the outwardly facing surface of the first leg of the body and the lip portion is co-planar with the top surface of the body, the lip portion having a first end, a second end, a top surface, a bottom surface, and a laterally outer edge, the lip portion extending between the first end of the body and the second end of the body, and having a thickness between the top surface of the lip portion and the bottom surface of the lip portion; a plurality of spacedly arrayed threaded through holes defined in one leg of the body and communicating with the channel, each of the plurality of threaded through holes sized and configured to carry a threaded set screw therein to releasably secure the snow brake anchor to a standing seam that is straddled by the body between the first leg and the second leg, the threaded set screws, when tightened, frictionally compressing the standing seam that is within the channel against an opposing leg of the body opposite the threaded set screws and without penetrating the standing seam; a plurality of spacedly arrayed holes defined in the lip portion communicating from the top surface to the bottom surface, the plurality of said holes sized and configured to carry fasteners therein to releasably secure a snow brake to the snow brake anchor; the snow brake configured to prevent accumulations of snow on the inclined roof from sliding off the inclined roof, the snow brake having a first end, a second end, a first edge, a second edge, a top surface, a bottom surface, and defining a plurality of spacedly arrayed through holes communicating between the top surface and the bottom surface, each of the spacedly arrayed holes defined in the snow brake being aligned with one of the threaded through holes defined in the lip portion of the body so as to engage with and carry a fastener to secure the snow brake to the anchor body; and the position and orientation of the threaded through holes defined one leg of the body and the threaded through holes defined in the lip portion are such that the threaded set screws and threaded fasteners are accessible to a user when the snow brake is secured to the snow brake anchor and such that the threaded set screws and threaded fasteners do not interfere with the installation of each other when engaged with the body and the lip portion.

A further aspect of the present invention is a snow brake anchoring system wherein the threaded set screws are formed of stainless steel.

A further aspect of the present invention is a snow brake anchoring system wherein the threaded set screws have a hexagonal turning member defined within one end of each set screw.

A further aspect of the present invention is a snow brake anchoring system wherein the threaded set screws have threading disposed about an outer surface of a body of each of the threaded set screws.

A further aspect of the present invention is a snow brake anchoring system wherein each of the threaded fasteners has a radially enlarged head portions.

DETAILED DESCRIPTION OF THE PREFERRED EMBODIMENTS

This disclosure of the invention is submitted in furtherance of the Constitutional purposes of the U.S. Patent Laws "to promote the progress of science and useful arts" (Article I, Section 8).

Figure 1:
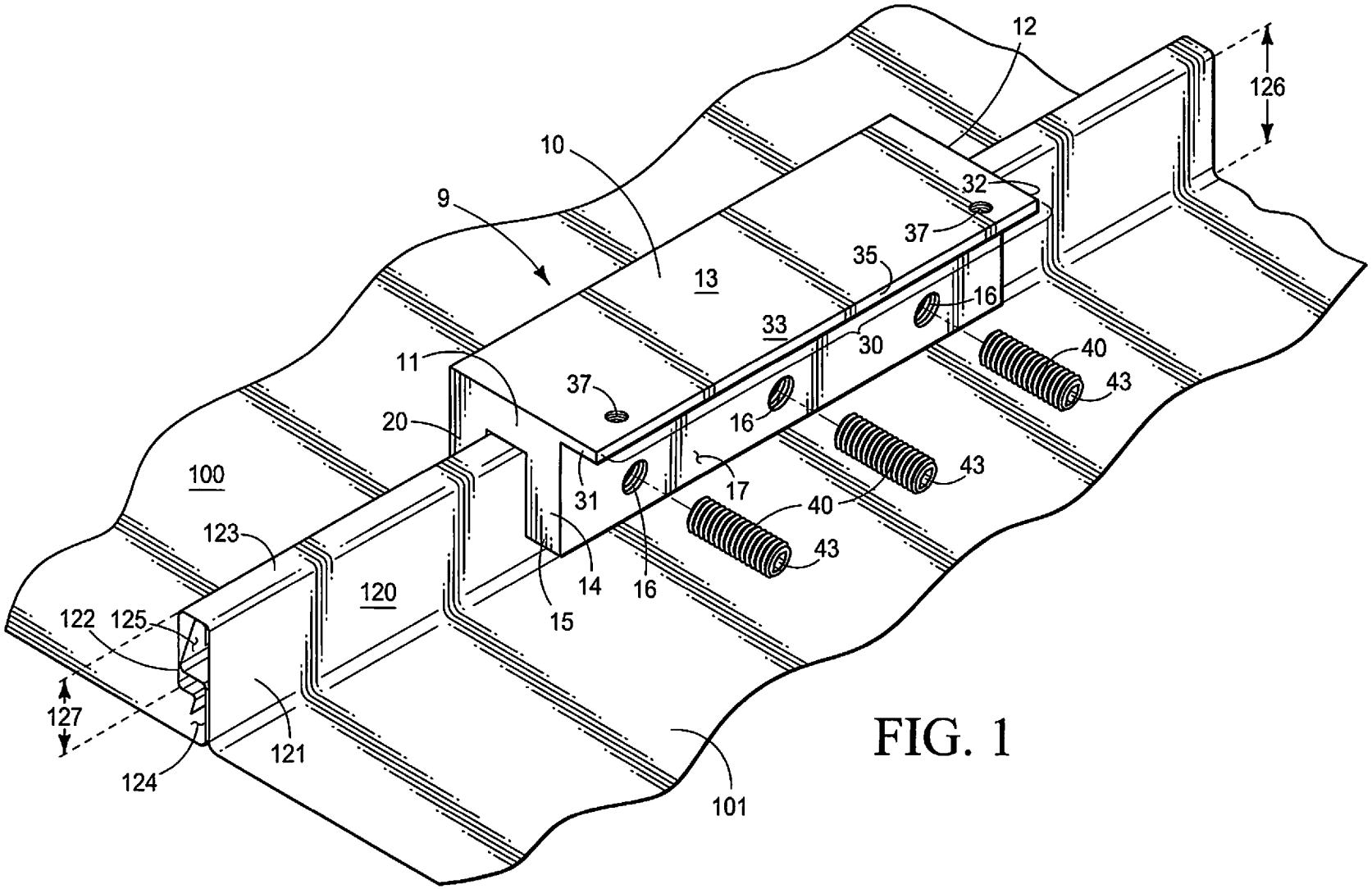
FIG. 1 is an isometric top, side, and end view of the instant snow brake anchor, set screws, and a standing seam, with the roof rib anchor engaged with the standing seam.
Figure 5:
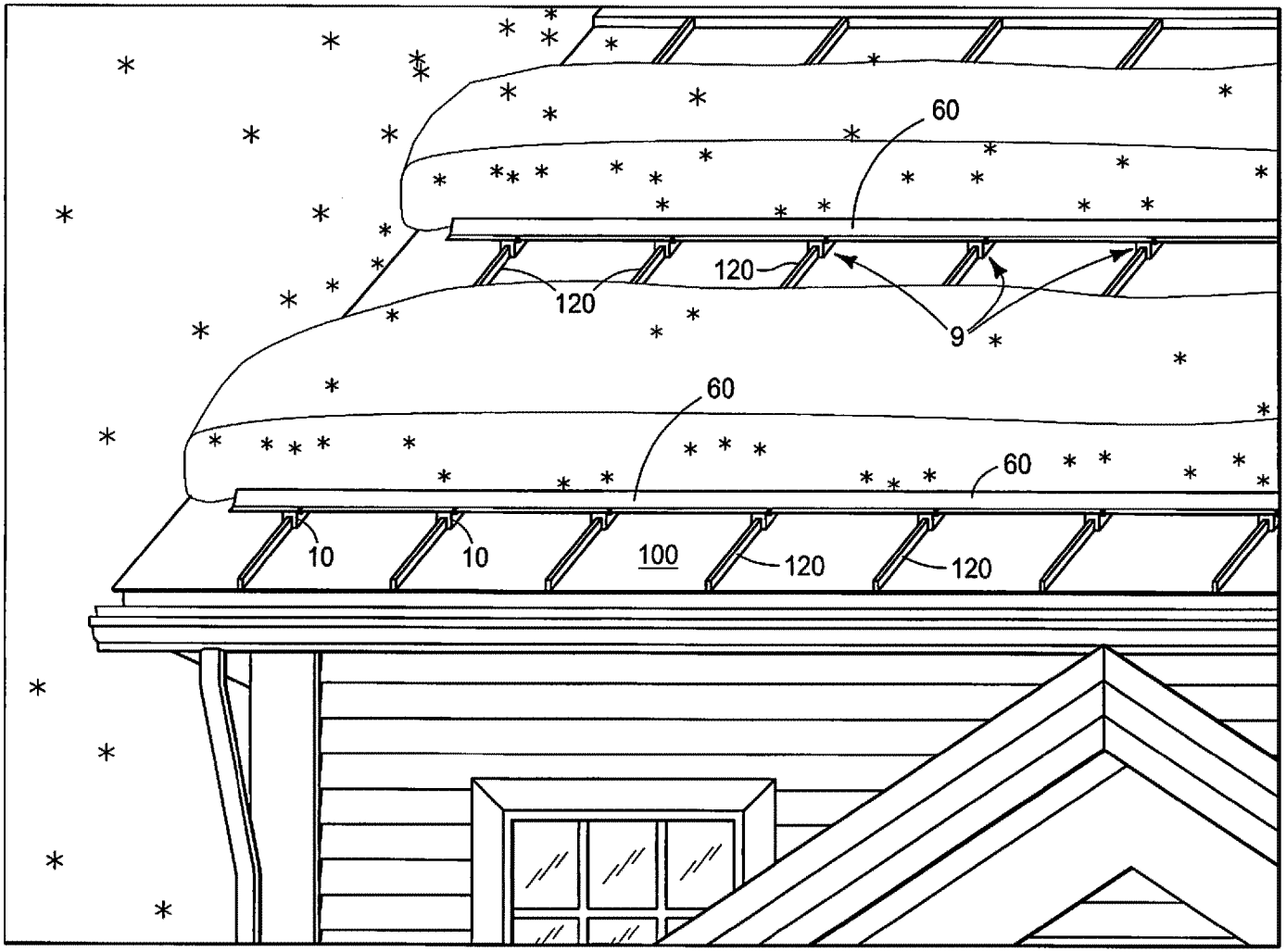
FIG. 5 is an isometric top, side, and end view of the snow brake anchor system, in an assembled and installed configuration on a roof with standing seams, with a gutter system installed on the roof, and showing an accumulation of snow.

As shown in FIG. 1, the instant snow brake anchor system generally provides a snow brake anchor 9 having a body 10, with a first end 11, a second end 12, a top surface 13, a first leg 14, a second leg 20, and defining a channel 22 between the two legs 14, 20. The body 10 may be machined from a single piece of bar stock. Alternatively, the body 10 may be assembled from multiple pieces of bar stock that are interconnected to one another. The snow brake anchor 9 is of sufficient thickness to maintain rigidity and strength when acted upon by a force of a weight of accumulated snow (FIG. 5). The first leg 14 and the second leg 20 may have a configuration of rectangular cuboids. The first leg 14 has a bottom 15, an outwardly facing surface 17, and an inwardly facing surface 18 that forms part of the channel 22. The second leg 20 also has a bottom 21, an outwardly facing surface 27, and an inwardly facing surface 28 that forms another part of the channel 22. Although the bottoms 15, 21 of the legs 14, 20 respectively, are shown in the Figures as rectangular, it is contemplated the bottoms 15, 21, may also be other than rectangular surfaces, such as, but not limited to convex or concave (not shown). The body 10 has a laterally extending lip portion 30 that extends perpendicularly away from the outwardly facing surface 17 of the first leg 14 of the body 10 and the lip portion 30 is co-planar with the top surface 13 of the body 10. Further, the body 10 includes a plurality of spacedly arrayed threaded through holes 16 defined in the first leg 14 of the body 10. Alternatively, the plurality of threaded through holes 16 may be defined in the second leg 20 of the body 10. Each of the plurality of threaded through holes 16 is sized and configured to carry a threaded set screw 40 therein. The body 10 further includes a plurality of spacedly arrayed threaded through holes 37 defined in the lip portion 30 communicating between the top surface 33 of the lip portion 30 to the bottom surface 34 of the lip portion 30.

Figure 2:
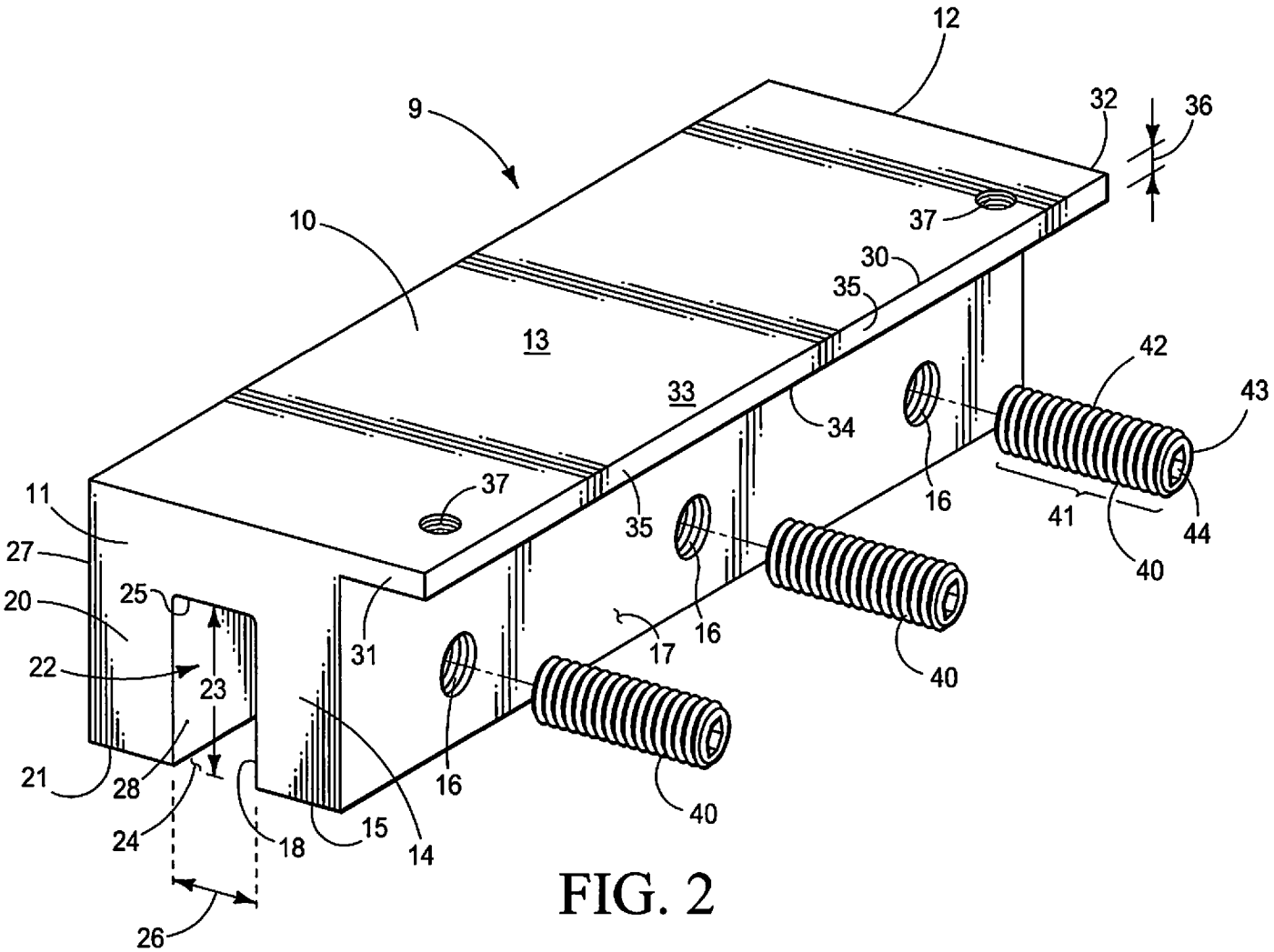
FIG. 2 is an enlarged isometric top, side, and end view of the instant snow brake anchor and set screws, in an unassembled configuration.

As shown in FIG. 2, the channel 22 extends between the first end 11 and the second end 12 of the body 10 between the inwardly facing surface 18 of the first leg 14 and the inwardly facing surface 28 of the second leg 20. The channel 22 may be rectangular. The channel 22 has a depth dimension 23 between a channel opening 24 and a channel base 25. The channel opening 24 is defined between the bottom 15 of the first leg 14 and the bottom 21 of the second leg 20, and defines a width dimension 26. The channel base 25 is defined by a transverse face opposite the channel opening 24. The transverse face of the channel base 25 may be rectangular. Alternatively, the transverse face of the channel 25 may be other than rectangular (not shown). The plurality of spacedly arrayed threaded through holes 16 defined in the first leg 14 (or second leg 20) of the body 10 communicate with the channel 22.

Optionally, the body 10 may include a friction enhancing and corrosion resistant insert (not shown) disposed within channel 22. The insert may be disposed on any or all of the inwardly facing surface 18 of the first leg 14, the inwardly facing surface 28 of the second leg 20, and/or the channel base 25. It is contemplated the insert (not shown) may be composed of a durable, temperature resistant polymer, and may have ridges or other surface configurations to enhance the friction between the body 10 and the standing seam 120, and also to prevent corrosion therebetween.

The lip portion 30 has a first end 31 proximate the first end 11 of the body 10, a second end 32 proximate the second end 12 of the body 10, a top surface 33 co-planar with the top surface 13 of the body 10, a bottom surface 34 that joins with the outwardly facing surface 17 of the first leg 14, and a laterally outer edge 35 opposite the outwardly facing surface 17 of the first leg of the body 10. The lip portion 30 has a thickness 36 between the top surface 33 and the bottom surface 34.

The plurality of spacedly arrayed threaded through holes 37 defined in the lip portion 30 are located approximately equidistant from the laterally outer edge 35 and the outwardly facing surface 17 of the first leg 20.

Figure 3:
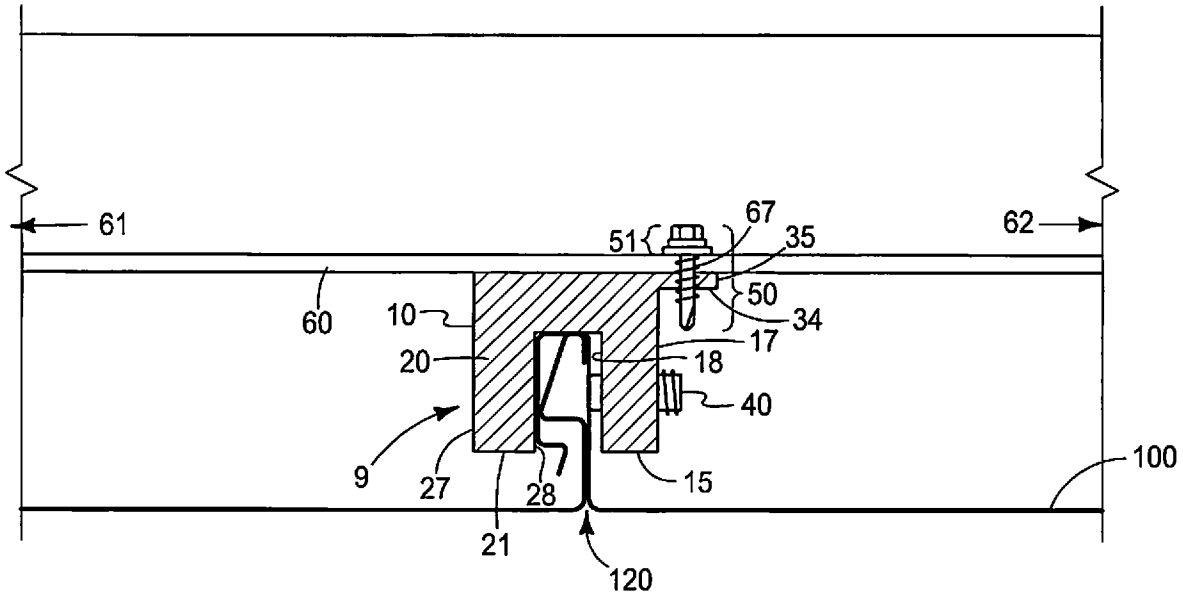
FIG. 3 is an orthographic cross-sectional view of the instant snow brake anchor system taken on line 3-3 of FIG. 4 and showing the snow brake anchor, the standing seam, the roof, the snow brake, the set screws, and the fasteners.

The body 10 and the channel 22 together, excluding the lip portion 30, preferably have a substantially rectangular cross-sectional shape. (FIG. 3). Optionally, this rectangular cross-sectional shape may be a square cross-sectional shape.

The snow brake anchor 9 body 10 is preferably composed of a metallic alloy. Optionally, this metallic alloy is heat-treated aluminum. Alternatively, the snow brake anchor 9 body 10 is composed of a durable, temperature resistant polymer.

The plurality of threaded set screws 40 releasably secure the snow brake anchor 9 to a standing seam 120 of the planar roof 100, by engaging with and compressing the standing seam 120 that is within channel 22 defined by the body 10. The threaded set screws 40 compress the generally planar second side 122 of the standing seam 120 against the inwardly facing surface 28 of the second leg 20 of the body 10. The threaded set screws 40, when tightened and compressing the standing seam 120 within the channel 22, do not penetrate the generally planar first side 121 nor any other portion of the standing seam 120. Preferably, the threaded set screws 40 are tightened to a predetermined torque so as to prevent any penetration. The generally planar top portion 123 of the standing seam may contact the channel base 25.

The threaded set screws 40 are optionally formed of stainless steel and may have an internal or external turning member 44 at end 43 of each threaded set screw 40. Other turning members are contemplated by the present invention. The threaded set screws 40 may include threading 42 disposed about an entire circumferential outer surface of a body 41 of the threaded set screws 40. The plural threaded set screws 40 may also include threading 42 disposed about only a portion of the outer circumferential surface of the body 41 of the threaded set screws 44, where the portion is less than the entire outer surface and further may have an end that is rounded (not pictured) and does not have threading 42 (not pictured). The rounded end contributes to the non-penetrative aspect of the threaded set screws 40, in that the there is no drilling effect as there would be with a threaded distal end in contact with the standing seam 120. Alternatively, the end 43 may be planar. This avoids the same drawback of a drilling effect from threading 42 touching the generally planar first surface 121 of the standing seam 120 as the threaded set screws 40 are tightened.

The body 41 of the threaded set screw 40 may optionally have a length such that tightening the threaded set screw 40 until the end 43 of the threaded set screw 40 is co-planar with the outwardly facing surface 17 of the first leg 14 compresses the standing seam an optimal amount. This optimal amount compresses the standing seam such that the snow brake anchor 9 is secured to the standing seam 120 without penetrating the standing seam 120 and with enough frictional force to withstand a force of a weight of accumulated snow without the snow brake anchor 9 moving relative to the standing seam 120.

The plurality of spacedly arrayed threaded through holes 16 defined in the first leg 14 of the body 10 are preferably located approximately equidistant between the channel base 25 and the bottom 15 of the first leg 14.

As shown in FIG. 2, the plurality of threaded through holes 37 are sized and configured to carry threaded fasteners 50 therein to releasably secure a snow brake 60 to the snow brake anchor 9.

Figure 4:
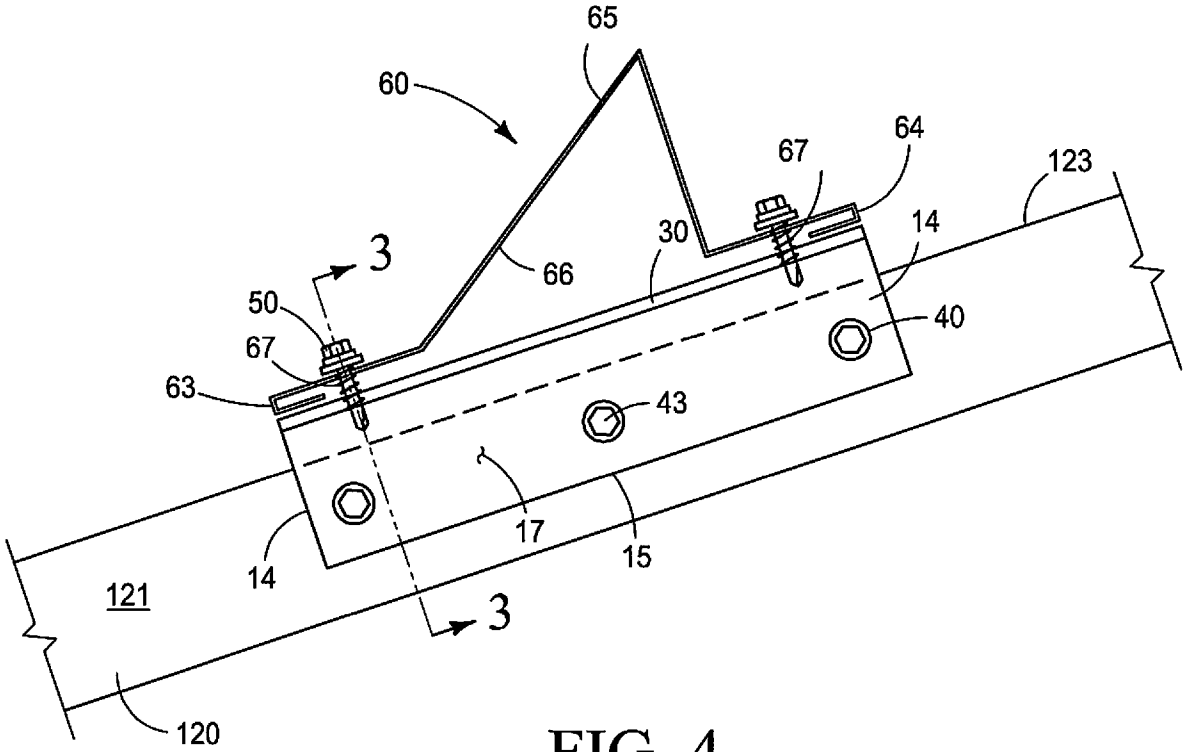
FIG. 4 is an orthographic side view of the snow brake anchor system of FIG. 3.

The snow brake 60 is configured to prevent accumulations of snow on the inclined roof 100 from sliding off the inclined roof 100. Best shown in FIGS. 3 and 4, the snow brake 60 has a first end 61, a second end 62, a downward edge 63 (FIG. 4), an upward edge 64 (FIG. 4), and defines a plurality of spacedly arrayed through holes 67 communicating between a top surface 65 (FIG. 4) and a bottom surface 66 (FIG. 4). Each of the spacedly arrayed holes 67 defined in the snow brake 60 may be aligned with one of the threaded through holes 37 defined in the lip portion 30 of the body 10 so as to engage therewith to secure the snow brake 60 to the body 10.

In another, preferred embodiment, the lip portion or the body 10 may not include any predrilled holes 37. Further, the snow brake may not include any predrilled holes 67. Either of the plurality of threaded through holes 37 or the plurality of spacedly arrayed through holes 67 may be included in the snow brake anchor system, or neither may be included. In the alternative, preferred embodiment when neither the plurality of threaded through holes 37, nor the plurality of spacedly arrayed through holes 67 are present, the fasteners 50 may be self-tapping fastening devices that are capable of penetrating simultaneously through the snow brake 60 and the lip portion 30 of the body 10.

The position and orientation of the threaded through holes 16 defined in the first leg 14 of the body 10 are such that the threaded set screws 40 and threaded fasteners 50 are accessible to a user when a snow brake 60 is secured to the snow brake anchor 9. These positions and orientations are such that the threaded set screws 40 and threaded fasteners 50 do not interfere with the installation of each other when engaged with the body 10, the snow brake 60, and the lip portion 30.

The threaded fasteners 50 may be selected from a group comprising number 12 through number 14 fasteners. The threaded fasteners 50 may have radially enlarged head portions 51. The radially enlarged head portions 51 may be a larger diameter than the plurality of spacedly arrayed threaded through holes 37 defined in the lip portion 30 or the body of the threaded fasteners 50. In this manner, the enlarged head portions 51 enable the fasteners 50 to be tightened, such as with a ratchet type tool. The enlarged head portions 51 will not pass through the threaded through holes 37 in the lip portion 30 or the spacedly arrayed holes 67 in the snow brake 60.

As shown in FIG. 5, a plurality of spacedly arrayed snow brakes 60 may be installed on an inclined roof 100. A single elongate snow brake 60 may be attached to a plurality of spacedly arrayed anchor bodies 10 and the plurality of bodies 10 may be attached to a plurality of spaced apart standing seams 120. Thus, as shown in FIG. 5, multiple snow brakes 60 may hold amounts of snow on an inclined roof 100. In this manner, each snow brake 60 may hold less than the full amount of snow located on an inclined roof 100. By each snow brake 60 holding less than the full amount of snow location on an inclined roof 100, each body 10 is subjected to less force than if the full amount of snow was held by a single snow brake 60.

OPERATION

Having described the structure of my snow brake anchoring system, its use is hereinafter described.

As shown in FIGS. 1 and 3, standing seam 120 has a first part carried on a first edge of a planar roof panel 101 and a second part carried on a second edge of a planar roof panel 101. The first part of the standing seam 120 has a generally planar first side 121, a generally planar second side 122 opposite the first side 121, a generally planar top portion 123, a seam opening 124 located opposite the generally planar top portion 123, and defines an interior space 125. The interior space 125 is disposed between the interior surfaces of generally planar first side 121, the generally planar second side 122, the generally planar top portion 123, and the seam opening 124. The interior space 125 is collapsible responsive to compressive forces applied by the threaded set screws 40. The seam opening 124 is spaced vertically above the inclined surface 101 of the inclined roof 100. The generally planar second side 122 has a height dimension 127 that is less than the height dimension 126 of the generally planar first side 121, such that the seam opening 124 joins with the second generally planar side 122. The second part of the standing seam 120 is an upwardly standing lip (not shown) that extends through the seam opening 124 and is positionally maintained within the interior space 125. (See FIG. 3). The upwardly standing lip of the second part may have a configuration other than planar, so as to enhance and maintain engagement with the first part.

A user (not shown) would install the snow brake anchor system on an inclined roof 100. Preferably, the installation would take place when the roof is dry and cleared of debris and snow and ice for safety purposes. The user would calculate the number of anchor bodies 10 and snow brakes 60 needed for the snow brake anchoring system. For example, the user might consult historical snowfall data for the area of the building that the snow brake anchoring system is being installed on. Then the user could determine the anticipated maximal load of snow, and select the appropriate number and configuration of snow brakes 60. The user would then secure the bodies 10 to the standing seams 120 according to the predetermined calculations. The bodies 10 are aligned with each other, so that a snow brake 60 attaches to multiple aligned anchor bodies 10. This alignment may be performed by, for example, snapping a chalk line across the standing seams 120, and then locating the bodies 10 at the point where the perpendicular chalk line cross each of the standing seams 120.

The bodies 10 are secured to the standing seams 120 by inserting a threaded set screw 40 into one of the threaded through holes 16 in the first leg 14 of the anchor bodies, and then tightening the threaded set screws 40 with an appropriate tool, such as an Allen wrench or drill with an appropriate drill bit, until the standing seams 120 are compressed by the threaded set screws 40. When the threaded set screws 40 are tightened, the bodies 10 are secured to the standing seams 120. Optionally, the user would leave the threaded set screws 40 tightened enough that the bodies 10 do not move, but still loose enough that the bodies 10 can be positionally adjusted along the standing seams 120. In this manner, the bodies 10 can be positionally adjusted up and down the standing seams 120 to enable installation of the snow brake 60. After the snow brake 60 is secured to the bodies 10, as described below, the threaded set screws 40 can be further tightened to secure the bodies 10 to the standing seams 120. Alternatively, the bodies 10 can be secured to the snow brake 60, as described below, prior to the bodies 10 being secured to the standing seams 120.

The snow brake 60 is secured to the bodies 10 by inserting and tightening the threaded fasteners 50 through the threaded through holes 67 of the snow brake 60 and also through the threaded through holes 37 of the lip portion 30 of the bodies 10. The radially enlarged head portions 51 of the threaded fasteners 50 are turned until the radially enlarged head portions 51 are flush and tightened to the top surface 65 of the snow brake 60. In this manner, the snow brake 60 is installed perpendicular to the standing seams 120.

One possible configuration includes installation process being repeated for installing a plurality of snow brakes 60, as shown in FIG. 5.

A first aspect of the present invention is a snow brake 60 anchoring system for an inclined roof 100 to prevent accumulations of snow from sliding off the inclined roof, 100 the roof 100 having a generally planar inclined surface with a plurality of spacedly apart generally parallel standing seams 120 that extend generally perpendicularly upwardly from the inclined roof surface 100, the snow brake anchoring system comprising a snow brake anchor 9 having an body 10 with a first end 11, a second end 12, a top surface 13, a first leg 14, a second leg 20, a bottom of the first leg 15, an outwardly facing surface 17, of the first leg 14, an inwardly facing surface 18 of the first leg 15, a bottom 21 of the second leg 20, an outwardly facing surface 27 of the second leg 20, and an inwardly facing surface 28 of the second leg 20, the body 10 defining a channel 22 extending between the first end 11 and the second end 12 and between the inwardly facing surface 18 of the first leg 14 and the inwardly facing 28 surface of the second leg 20, the channel 22 having a depth dimension 23 between a channel opening 24 between the bottom 15 of the first leg 14 and the bottom 21 of the second leg 20 and a channel base 25 defined by a transverse face proximate to the top surface 13 of the body 10, the body 10 further having a laterally extending lip portion 30 that extends perpendicularly away from the outwardly facing surface 17 of the first leg 14 of the body 10 and is co-planar with the top surface 13 thereof, the lip portion 30 having a first end 31, a second end 32, a top surface 33, a bottom surface 34, and a laterally outer edge 35, the lip portion 30 extending between the first end 11 of the body 10 and the second end 12 of the body 10, and having a thickness 36 between the top surface 33 of the lip portion 30 and the bottom surface 34 of the lip portion 30; fasteners 40 for releasably securing the snow brake anchor 9 to the standing seam 120 that is within the channel 120 without penetrating the standing seam 120; and fasteners 50 for releasably securing a snow brake 60 to the snow brake anchor 9.

A further aspect of the present invention is a snow brake anchoring system wherein the plurality of spacedly arrayed threaded through holes 16 defined in the first leg 14 of the body 10 comprise three spacedly arrayed threaded through holes 16 defined in the first leg 14 that are located approximately equidistant from the channel base 25 and the bottom 15 of the first leg 14 of the body 10, a first 16 of the three spacedly arrayed threaded through holes 16 located proximate the first end 11, a second 16 of the three spacedly arrayed threaded through holes 16 located proximate the second end 12, and a third 16 of the three spacedly arrayed threaded through holes 16 located approximately equidistant from the first end 11 and the second end 12 of the body 10.

A further aspect of the present invention is a snow brake anchoring system wherein the first 16 of the three spacedly arrayed threaded through holes 16 defined in the first leg 14 and the second 16 of the three spacedly arrayed threaded through holes 16 defined in the first leg 14 are located approximately equidistant from the third 16 of the spacedly arrayed threaded through holes 16 defined in the first leg 14.

A further aspect of the present invention is a snow brake anchoring system wherein the plurality of spacedly arrayed threaded through holes 37 defined in the lip portion 30 are located approximately equidistant from the laterally outer edge 35 and the outwardly facing surface 17 of the first leg 14, a first 37 of the plurality of spacedly arrayed threaded through holes 37 defined in the lip portion 30 located proximate the first end 31, and a second 37 of the plurality of spacedly arrayed threaded through holes 37 defined in the lip portion 30 proximate the second end 32.

A further aspect of the present invention is a snow brake anchoring system wherein the body 10 and the channel 22 together, excluding the lip portion 30, have a substantially rectangular cross-sectional shape.

A further aspect of the present invention is a snow brake anchoring system wherein the body 10 and the channel 22 together, excluding the lip portion 30, have a substantially square cross-sectional shape.

A further aspect of the present invention is a snow brake anchoring system wherein the snow brake anchor 9 is composed of a metallic alloy.

A further aspect of the present invention is a snow brake anchoring system wherein the snow brake anchor 9 is comprised of heat-treated aluminum.

A further aspect of the present invention is a snow brake anchoring system wherein the snow brake anchor 9 is composed of a durable, temperature resistant polymer.

A further aspect of the present invention is a snow brake anchoring system wherein the channel 22 is rectangular.

A further aspect of the present invention is a snow brake anchoring system wherein the channel 22 base 25 is arcuate.

A further aspect of the present invention is a snow brake anchoring system wherein the first leg 14 and the second leg 20 are substantially rectangular cuboids.

A further aspect of the present invention is a snow brake anchoring system for an inclined roof 100 to prevent accumulations of snow from sliding off the inclined roof 100, the roof 100 having a generally planar inclined surface with a plurality of spacedly apart generally parallel standing seams 120 that extend generally perpendicularly upwardly from the inclined roof surface 100, the snow brake anchoring system comprising a snow brake anchor 9 having an body 10 with a first end 11, a second end 12, a top surface 13, a first leg 14, a second leg 20, a bottom of the first leg 15, an outwardly facing surface 17 of the first leg 14, an inwardly facing surface 18 of the first leg 14, a bottom 21 of the second leg 20, an outwardly facing surface 27 of the second leg 20, and an inwardly facing surface 28 of the second leg 20, the body 10 defining a channel 22 extending between the first end 11 and the second end 12 and between the inwardly facing surface 18 of the first leg 14 and the inwardly facing surface 28 of the second leg 20, the channel 22 having a depth dimension 23 between a channel opening 24 between the bottom 15 of the first leg 14 and the bottom 21 of the second leg 20 and a channel base 25 defined by a transverse face 25 proximate to the top surface 13 of the body 10, the body 10 further having a laterally extending lip portion 30 that extends perpendicularly away from the outwardly facing surface 17 of the first leg 14 of the body 10 and is co-planar with the top surface 13 thereof, the lip portion 30 having a first end 31, a second end 32, a top surface 33, a bottom surface 34, and a laterally outer edge 35, the lip portion 30 extending between the first end 11 of the body 10 and the second end 12 of the body 10, and having a thickness 36 between the top surface 33 of the lip portion 30 and the bottom surface 34 of the lip portion 30; a plurality of spacedly arrayed threaded through holes 16 defined in either the first leg 14 or the second leg 20 of the body 10 and communicating with the channel 20, each of the plurality of threaded through holes 16 sized and configured to carry a threaded fastener 40 therein to releasably secure the snow brake anchor 9 to said one of the generally parallel standing seams 120 that is positioned within the channel 20 defined by the body 10 and straddled by the body 10 between the first leg 14 and the second leg 20, the threaded set screws 40, when tightened, frictionally compressing the standing seam 120 that is within the channel 120 against the first leg 14 or the second leg 20 of the body 10 opposite the threaded set screws 40 and without penetrating the standing seam 120; a plurality of spacedly arrayed threaded through holes 37 defined in the lip portion 30 communicating from the top surface 33 to the bottom surface 34, the plurality of said threaded through holes 37 sized and configured to carry threaded fasteners 50 therein to releasably secure a snow brake 60 to the snow brake anchor 9; the snow brake 60 configured to prevent accumulations of snow on the inclined roof 100 from sliding off the inclined roof 100, the snow brake 60 having a first end 61, a second end 62, a first edge 63, a second edge 64, a top surface 65, a bottom surface 66, and defining a plurality of spacedly arrayed through holes 67 communicating between the top surface 65 and the bottom surface 66, each of the spacedly arrayed holes 67 defined in the snow brake 60 being aligned with one of the threaded through holes 37 defined in the lip portion 30 of the body 10 so as to engage with and carry the threaded fasteners 50 to secure the snow brake 60 to the body 10; and; the position and orientation of the threaded through holes 16 defined in the first leg 14 or the second leg 20 of the body 10 and the threaded through holes 37 defined in the lip portion 30 are such that the threaded set screws 40 and threaded fasteners 50 are accessible to a user when the snow brake 60 is secured to the snow brake anchor 9 and such that the threaded set screws 40 and threaded fasteners 50 do not interfere with the installation of each other when engaged with the body 10 and the lip portion 30.

A further aspect of the present invention is a snow brake anchoring system wherein the threaded set screws 40 are formed of stainless steel.

A further aspect of the present invention is a snow brake anchoring system wherein the threaded set screws 40 have a hexagonal turning member defined within one end of each set screw 40.

A further aspect of the present invention is a snow brake anchoring system wherein the threaded set screws 40 have threading disposed about an entire outer surface of a body of each of the threaded set screws.

A further aspect of the present invention is a snow brake anchoring system wherein each of the threaded fasteners 50 has a radially enlarged head portions.

In compliance with the statute, the invention has been described in language more or less specific as to structural and methodical features. It is to be understood, however, that the invention is not limited to the specific features shown and described since the means herein disclosed comprise preferred forms of putting the invention in to effect. The invention is, therefore, claimed in any of its forms or modifications within the proper scope of the appended claims appropriately interpreted in accordance with the Doctrine of Equivalents.

I claim:

1. A snow brake anchoring system for an inclined roof to prevent accumulations of snow from sliding off the inclined roof, the inclined roof having a plurality of spaced apart generally parallel standing seams extending upwardly from the inclined roof surface, the snow brake anchoring system comprising:

a snow brake anchor having a unitary body with a first end, a second end, a top surface, a first leg and a second leg, and the second leg is parallel to the first leg, the unitary body defining a fixed-width rectilinear channel between an inwardly facing surface of the first leg and an inwardly facing surface of the second leg, the rectilinear channel defining a channel opening opposite the top surface, and the inwardly facing surfaces are parallel to one another, and the rectilinear fixed-width channel extends between the first end and the second end, the unitary body further having a lip portion that extends laterally perpendicularly outwardly from an outwardly facing surface of the first leg of the unitary body and the lip portion has a top surface that is co-planar with the top surface of the unitary body;

a plurality of spacedly arrayed threaded through holes defined in the second leg of the body communicating between an outwardly facing surface of the second leg and the rectilinear channel, and each of the plurality of threaded through holes is sized and configured to releasably carry a threaded set screw therein to releasably positionally secure the snow brake anchor to one of the said generally parallel standing seams of the inclined roof by means of direct physical, and non-penetrating, contact by an end portion of the threaded set screw that extends into the rectilinear channel, against the standing seam that is within the rectilinear channel so as to compress the standing seam that is within the rectilinear channel between the threaded fastener and the inwardly facing surface of the first leg; and the lip portion is integral with the unitary body and is generally perpendicular to the rectilinear channel and is configured to receive fasteners to releasably secure a snow brake to the snow brake anchor body.

2. The snow brake anchoring system of claim 1 wherein the snow brake unitary anchor body is composed of a metallic alloy.

3. The snow brake anchoring system of claim 1 wherein the snow brake unitary anchor body is composed of a durable, temperature resistant polymer.

4. The snow brake anchoring system of claim 1 wherein the threaded set screws have a hexagonal turning member defined within one end of each threaded set screw.

5. The snow brake anchoring system of claim 1 wherein each of the threaded set screws have threading disposed about an entire outer surface of a body of each of the threaded set screws.

6. The snow brake anchoring system of claim 1 wherein the transverse wall opposite the channel opening is arcuate in shape.

7. The snow brake anchoring system of claim 1 wherein the plurality of spacedly arrayed threaded through holes configured to carry the threaded set screws are defined in the first leg of the unitary anchor body.

8. The snow break anchoring system of claim 1 and wherein the snow brake is elongate and has a planar portion on an underside surface thereof configured to frictionally communicate with the top surface of the lip portion of plural spaced apart anchor bodies, and the elongate snow break has an upper surface that is configured to prevent accumulations of snow on the inclined roof from sliding off the inclined roof, the snow brake defining a plurality of spacedly arrayed through holes communicating between the upper surface and the underside surface that align with the lip portions of the plural unitary bodies to carry the fasteners to secure the elongate snow brake to the plural spaced apart bodies anchored to the inclined roof.

9. A snow brake anchoring system for an inclined roof to prevent accumulations of snow from sliding off the inclined roof, the roof having a generally planar inclined surface with a plurality of spacedly apart generally parallel standing seams that extend generally perpendicularly upwardly from the inclined roof surface, the snow brake anchoring system comprising:

a snow brake anchor having a unitary body with a first end, a second end, a top surface, bottom, a first leg, a second leg, a bottom of the first leg, an outwardly facing surface of the first leg, an inwardly facing surface of the first leg, a bottom of the second leg, an outwardly facing surface of the second leg, and an inwardly facing surface of the second leg, the unitary body defining a fixed-width rectilinear channel extending between the first end and the second end and between the inwardly facing surface of the first leg and the inwardly facing surface of the second leg, the channel defining a channel opening at the bottom and having a depth dimension between the channel opening, a channel base defined by a transverse face opposite the channel opening, the body further having a laterally extending lip portion that extends perpendicularly outwardly from the outwardly facing surface of the first leg of the body and the laterally extending lip portion has an upper surface that is co-planar with the top surface of the unitary body, the laterally extending lip portion having a first end, a second end, a top surface, a bottom surface, and a laterally outer edge, the laterally extending lip portion extending between the first end of the body and the second end of the body, and having a thickness between the top surface of the laterally extending lip portion and the bottom surface of the laterally extending lip portion;

a threaded set screw releasably and adjustably carried in a threaded through hole defined in the second leg of the unitary body and communicating with the rectilinear channel for releasably securing the snow brake anchor to the standing seam that is within the rectilinear channel without penetrating the standing seam;

an elongate snow brake having a first end, an opposing second end, an underside surface and a upper surface, the underside surface having a planar portion configured to frictionally communicate with the top surface of the laterally extending lip portion of plural spaced apart anchor bodies, and the upper surface of the elongate snow break is configured to prevent accumulations of snow on the inclined roof from sliding off the inclined roof, the snow brake defining a plurality of spacedly arrayed through holes communicating between the upper surface and the underside surface that align with the laterally extending lip portions of the plural unitary bodies; and plural threaded fasteners to secure the elongate snow brake to the plural spaced apart bodies anchored to the inclined roof.

* * * * *